US005561038A

United States Patent [19]

Goan

[11] Patent Number: 5,561,038

[45] Date of Patent: Oct. 1, 1996

[54] SILVER HALIDE BLACK AND WHITE PHOTOGRAPHIC LIGHTSENSITIVE MATERIAL

[75] Inventor: Kazuyoshi Goan, Tokyo, Japan

[73] Assignee: Konica Corporation, Tokyo, Japan

[21] Appl. No.: 520,601

[22] Filed: Aug. 29, 1995

[30] Foreign Application Priority Data

Sep. 1, 1994 [JP] Japan ..... 6-208665

[51] Int. Cl.[6] ..... G03C 1/005; G03C 1/494

[52] U.S. Cl. ..... 430/567; 430/502; 430/496

[58] Field of Search ..... 430/495, 496, 430/502, 567, 966

[56] References Cited

U.S. PATENT DOCUMENTS

| | | | |
|---|---|---|---|
| 3,057,723 | 10/1962 | Jeffreys et al. | 430/449 |
| 3,396,029 | 8/1968 | Himmelmann et al. | 430/621 |
| 4,161,407 | 7/1979 | Campbell | 430/621 |
| 4,399,215 | 8/1983 | Wey | 430/567 |
| 4,826,757 | 5/1989 | Yamada et al. | 430/966 |
| 5,424,178 | 6/1995 | Tsuzuki | 430/567 |

*Primary Examiner*—Geraldine Letscher

*Attorney, Agent, or Firm*—Finnegan, Henderson, Farabow, Garrett & Dunner, L.L.P.

[57] ABSTRACT

A silver halide black and white photographic light sensitive material comprising a support having thereon at least two silver halide emulsion layers, a first silver halide emulsion layer being provided on a second silver halide emulsion layer, wherein the first silver halide emulsion layer comprises silver halide tabular grains containing 50 mol % or more chloride and having an average aspect ratio of 3 or more, the second silver halide emulsion layer comprising silver bromide grains or silver iodobromide grains containing 2 mol % or less iodide, and a swelling ratio of the total hydrophilic colloidal layers being 200% or less.

4 Claims, No Drawings

SILVER HALIDE BLACK AND WHITE PHOTOGRAPHIC LIGHTSENSITIVE MATERIAL

FIELD OF THE INVENTION

The present invention relates to a silver halide light-sensitive photographic material. More specifically, the present invention relates to a silver halide light-sensitive photographic material having enhanced sensitivity, improved image quality and less dependence upon the processing thereof.

BACKGROUND OF THE INVENTION

Recently, consumption of silver halide light-sensitive photographic materials has kept on increasing. As a result, number of the silver halide light-sensitive photographic materials to be processes have increased and, therefore, adaptability of the silver halide light-sensitive materials to rapid processing, or increase in the amount of processing within a fixed period of time has been a strong demand.

Such a tendency is applicable to every other field of silver halide photography. For example in the field of medical radiography, the number of diagnoses and items of inspection, the number of photographs to be taken have increased, and due to necessity for patients to be advised by a doctor as soon as possible, further shortening of the processing time is strongly demanded. Particularly, in the fields of arteriography or photography during surgerical operations, it becomes necessary for the pictures to be seen by a doctor as quickly as possible and in order to satisfy this requirement, further development of automated diagnostic system, (including shooting and transportation, etc.) and rapid processing system of x-ray films are demanded.

However, it is well known that the rapid processing, which is usually carried out under high pH and high temperature(30° to 40° C.) conditions, often accompanies deterioration of image qualities. Particularly, in the case of rapid processing under high temperature by the use of a processor, so-called "roller mark" take place due to pressure of transporting rollers, which often lead to such image quality deterioration. Occurrence of the roller mark itself may be restrained by enhancing hardness of photographic layers and lowering swelling thereof. However, this invites deterioration in adaptability of photographic materials to processing; particularly in the rapid process, sensitivity and image contrast are often lowered and, thus, satisfactory performance may not be obtained.

In reply to such a demand for adaptability to rapid processing, tabular-shaped silver halide grains came to be employed. Since the tabular-shaped silver halide grain has relatively large specific surface area, it can adsorb a large quantity of sensitizing dye and, therefore, it is capable of enhancing spectral sensitivity, as well as reducing the cross-over effect and light scattering in the light-sensitive materials for x-ray exposure and, thus, it has characteristics of giving an image of high resolving power.

Accordingly, by using this tabular-shaped grains, there is expectation that a silver halide light-sensitive photographic material with enhanced sensitivity and improved image quality may be developed, however, this tabular-shaped grain has a defect that it is likely to cause fog due to pressure. Thus, for example, folding the light-sensitive material during handling thereof easily causes blackening, and friction with other material such as a transporting roller in the processor often brings about stringy fog, which can be a hindrance to accurate diagnosis. Although this kind of fogging may be improved by enhancing the layer hardness, however, as mentioned above, this leads to deterioration of processing performance and, therefore, may not be an effective means. Recently. in particular, due to strict environmental controls, a processing system which discharges reduced liquid wastes by reducing replenishing amount of processing solutions. However, in the processing with reduced replenishment, accumulation tends to be condensed easily, which results in enlarging variation or deterioration by the process. When silver chloride is used as the silver halide grain, effect of accumulation of halide ions can be improved because the effect of the halide ions on the developing solution is considerably small with respect to $Cl^-$ in comparison with $Br^-$ or $I^-$. However, it is difficult to give sufficient sensitivity and, thus, satisfactory performance is not obtainable.

OBJECT OF THE INVENTION

In view of the problems mentioned above, the object of the present invention is to provide a silver halide light-sensitive photographic material, which has high sensitivity, is capable producing an image with improved image quality and is less dependent on the processing thereof.

SUMMARY OF THE INVENTION

The above-mentioned object of the present invention can be achieved by a silver halide light-sensitive photographic material comprising at least two silver halide emulsion layers provided on a support, wherein the photographic material is characterized in that a silver halide emulsion layer which is provided nearer to the support comprises silver bromide or silver iodobromide grains having an iodide content of not more than 2 mol %; and the silver halide emulsion layer provided farther from the support comprises tabular-shaped silver halide grains having a chloride content of not less than 50 mol % and an aspect ratio of not less than 3, respectively and that the silver halide light-sensitive material is hardened so that a swelling ratio of the total hydrophilic colloid layers is not more than 200%.

In the processing of the silver halide light-sensitive photographic material mentioned avove, it is preferable that the processing is carried out while replenishing the developing solution at an amount not more than 200 ml per $m^2$ of the silver halide light-sensitive photographic material.

DETAILED DESCRIPTION OF THE PREFERRED EMBODIMENT

The silver halide grains used in the present invention is usually manufactured and used in the form of a silver halide emulsion. Among the emulsions used in the silver halide light-sensitive photographic material of the present invention, the emulsion used in the layer which is provided nearest to the support may be either silver bromide or silver iodobromide grains, and in view of light-sensitivity, silver iodobromide is preferable. The silver iodobromide grains contain 2 mol % or less iodide on the average, preferably 2 to 0.5 mol %. The silver halide grains may be of any shape including, for example, cubic, octahedral and tetradecahedral, which are crystals by isotropic growth.

Poly-hedral grains such as spherical grains or grains twinned crystal grains or tabular grains, which each have face defects, or composed types thereof. Further as regards halide composition inside the grain, it may be either uniform or layered structure, or so-called a core/shell structure. It is preferable that silver iodide content of the silver halide grain is 2 mol % or less.

The silver halide emulsion used in the layer provided farther from the support contains tabular-shaped silver halide grains having silver chloride content of 50 mol % or more and at least 50% and, more preferably, 70% of the total projection area of the grains contained therein are tabular-shaped grains, the aspect ratio grain diameter to thickness of three or more, and not more than 100. Still more preferably, the tabular-shaped grains have an average thickness smaller than 0.30 μm. These silver chloride-containing halide grains may either have light-sensitivity or, alternatively, they may be substantially non-light-sensitive grains.

The layer in which the silver chloride-containing halide grains are incorporated, may be any layer as far as it is an emulsion layer located farther from the support than the silver halide emulsion layer aforementioned. Thus, for example, it may be a protective layer which is usually an uppermost layer. Preferably, it is a layer provided between the emulsion layer located nearer to the support and the protective layer. The amount of silver chloride-containing halide grains contained in the layer may usually be 1.5 g/m$^2$ or less in terms of the amount of silver.

The silver halide photographic emulsion used in the present invention can be manufactured according to the method known in the art. For example, it may be prepared by either one of an acidic method, a neutral method or an ammoniacal method, and as a mode of reacting an aqueous silver salt with an aqueous halide, it is advantageous to employ a simultaneous double-jet mixing process. As one mode of the simultaneous mixing process, so-called a controlled double-jet process, in which pAg of the liquid phase is maintained constant, can be employed. According to this process, a silver halide emulsion containing silver halide grains of a uniform shape and size may easily be obtained. With regard to the adding rate, for example, descriptions in Japanese Patent O.P.I. Publication Nos., 54-48521(1979) and 58-49938(1983) can be referred to.

The silver halide photographic emulsion used in the present invention may be prepared by a process, which comprises, as a part thereof or the whole process thereof, a step of forming grains by supplying fine silver iodide-containing halide grains, as a source of iodide. Since the size of the fine grains dominates the supplying rate of the iodide ion, its preferable grain size is, depending on the size of the host grains or the halide composition thereof, 0.3 μm or less in terms of the average sphere equivalent diameter. More preferably, it is not more than 0.1 μm. In order for the fine grains to deposited on the surface of the host grains by re-crystallization, the grain size of the fine grains is preferably smaller than the sphere-equivalent diameter of the host grain and, more preferably, not greater than one tenth thereof. The preferable halide composition of the fine grains is that they contain silver iodide of not smaller than 95 mol % and, more preferably, they consist of silver iodide. The silver halide emulsion to be used to practice the present invention, can undergo a desalination process after completion of growth of the silver halide grains in order to adjust pAg of the emulsion at an appropriate concentration which is suitable to carry out chemical sensitization by means of a noodle washing process or flocculation sedimentation process. As preferable desalination process, for example, a method of using an aromatic hydrocarbonate-type aldehyde resin containing a sulfo group as disclosed in Japanese Patent Publication No. 35-16086(19600 and a method of using a polymeric coagulation agent such as Exemplified Compound G-3 or G-8, which is disclosed in Japanese Patent O.P.I. Publication No. 2-7037(1990) can be mentioned.

In the silver halide emulsion used in the present invention, various kinds of hydrophilic colloids as a binder for the silver halide. For this purpose, for example, gelatin, synthetic polymers such as polyvinyl alcohol and a polyacrylamide, and other photographic binders such as colloidal albumin, polysuccharide and cellullose derivatives can be used.

When the silver halide emulsion is subjected to chemical sensitization, usual sulfur sensitization, reduction sensitization, a sensitization using a noble metal compound or a combination thereof may be used. As for specific examples of such chemical sensitizer, for example, sulfur sensitizer such as an allylthiocarbamide, thiourea, a thiosulfate, thioether or cystin; a noble metal sensitizer such as potassium chloroaurate, aurous thiosulfate or potassium chloroparadate, and a reduction sensitizer such as tin chloride, phenylhydrazine or a reductone can be mentioned.

The photographic emulsion used to practice the present invention may be spectrally sensitized with one or more of cyanine dyes. The sensitizing dye may be applied either singly or two or more kinds in combination. Combined use of two or more kinds of sensitizing dyes may often be applied for the purpose of super-sensitization.

To the photographic material of the invention, a variety of photographic additives can be applied either before or after physical ripening or chemical ripening of the silver halide emulsion. As for such kinds of additives, for example, those compounds disclosed in the above-mentioned Research Disclosure Nos. 17,643, 18,716(November 1989) and 308, 119(December 1989) can be mentioned. The kinds of compounds and the relevant portions thereof are shown below.

| | RD-17643 | | RD-18716 | | RD-308119 | |
|---|---|---|---|---|---|---|
| Additive | Page | Section | Page | Section | Page | Section |
| Chemical sensi-tizer | 23 | III | 648 at upper right portion | | 996 | III |
| Sensitizing dye | 23 | IV | 648 to 649 | | 996 to 998 | IVA |
| Desensitizing dye | 23 | IV | | | 998 | IVB |
| Dye | 25 to 26 | VIII | 649 to 650 | | 1003 | VIII |
| Development accelerator | 29 | XXI | 648 upper right | | | |
| Antifoggant and stabilizer | 24 | IV | 649 upper right | | 1006 to 1007 | VI |
| Whitening agent | 24 | V | | | 998 | V |
| Surfactant | 26 to 27 | XI | 650 right | | 1005 to 1006 | XI |
| Antistatic agent | 26 to 27 | XI | 650 right | | 1006 to 1007 | |
| Plasticizer | 27 | XII | 650 right | | 1006 | XII |
| Lubricant | 27 | XII | 650 right | | 1006 | XII |
| Matting agent | 28 | XVI | 650 right | | 1008 to 1009 | XVI |
| Binder | 26 | XXII | | | 1009 to 1014 | XXII |
| Support | 28 | XVII | | | 1009 | XVII |

In the present invention, the photographic material is hardened so that a swelling ratio in percentage of layers coated on one side of a support is not greater than 200%. Herein the swelling ratio is expressed in the following equation.

Swelling Ratio={(Thickness of the layers after dipped into distilled water)−(Thickness of the layers before dipping)}/(Thickness of the layers before dipping)×100 (%).

Herein, the term "thickness of the layers before dipping" denotes the thickness of the layer of the photographic material after the material is subjected to an incubation treatment for 16 hours under the condition of 40° C. and 60% R.H. The term "the thickness after dipped in distilled water" means the thickness of the layer after the photographic material is dipped in the distilled water of 21° C. for three minutes. The swelling ratio can be adjusted, as this is well known in the art, by varying the amount of the hardener incorporated in the silver halide light-sensitive photographic material.

As for the hardening agent which is applicable to the present invention includes, for example, aldehyde compounds such as mucochloric acid, mucobromic acid, mucophenoxychloric acid, mucophenoxybromic acid, formaldehyde, dimethylolurea, trimethylolamine, glyoxal, monomethylglyoxal, 2,3-d-hydroxy- 1,4-dioxane, 2,3-dihydroxy-5-methyl-1,4-dioxane, succinic aldehyde, 2,5-dimethoxytetrahydrofurane and glutalaldehyde; active vinyl-type compounds such as divinylsulfon, methylenebismaleimide, 5-acetyl-1,3-diacroyl-hexahydro-s-triazine, 1,3,5-triacroyl-hexahydro-s-triazine, 1,3,5-trivinylsulfonylhexahydro-s-triazinebis(vinylsulfonylmethyl)ether, 1,3-bis-(vinylsulfonylmethylpropanol- 2, and bis(α-vinylsulfonylacetamide)ethane; active halide-type compounds such as 2,4-dichloro-6-hydroxy-s-triazine sodium salt, 2,4-dichloro-6-methoxy-s-triazine, 2,4-dichloro-6-(4-sulfoanilino)-s-triazine, sodium acid, 2,4-dichloro-6-(2-sulfoethylamino)-s-triazine and N,N-bis(2-chloroethylcarbamyl)pyperadine; epoxy-type compounds such as bis(2,3-epoxypropylmethylpropylammonium p-toluene sulfonate, 1,4-bis(2',3'-epoxypropyloxy)butane, 1,3,5-triglycidylisocyanulate, and 1,3-digtycidyl-5-(γ-acetoxy-β-oxypropyl)isocyanulate; ethyleneimine-type compounds such as 2,4,6-triethyleneimino-s-triazine and 1,6-hexamethylene-N,N-biaethyleneurea, bis-β-ethyleneiminoethylthioether; methanesulfonate-type compound such as 1,2-di(methanesulfonoxy)ethane, 1,4-di(methanesulfonoxy)butane, 1,5-di(methanesulfonoxy-)pentane;carbodiimide-type compound; isooxazole-type compound; inorganic compound such as chlomic alum and polymeric hardeners as disclosed in U.S. Pat. Nos. 3,057,723, 3,396,029 and 4,161,407 can be mentioned. The amount of the hardener used in the present invention may be varied depending upon type and nature of the hardener, drying conditions during manufacture of the photographic material, etc., however, it may optionally be adjusted within a range usually between 0.05 and 100 mmol and, especially between 0.1 and 50 mmols per 100 g of dry gelatin.

As for the support used for the silver halide light-sensitive photographic material of the present invention, those cited in the above-mentioned Research Disclosure can be mentioned. As an example of such a suitable support a plastic film, which has undergone subbing treatment such as corona discharge or ultraviolet-ray irradiation, or provision of a subbing layer in order to improve adhesion to the layer to be provided thereon. The silver halide emulsion used in the present invention can be provided on the both surfaces of the thus treated support.

If necessary, the silver halide light-sensitive photographic material of the present invention may comprise other layers, for example, an anti-halation layer, an intermediate layer and a filter layer.

Process of the silver halide light-sensitive photographic material of the present invention can be carried out with the processing solutions disclosed in XX through XXI, on pages 29 and 30 of Research Disclosure No.17,643 and on pages 1011 and 1012, XX through XXI of Research Disclosure No.308,119.

As for the developing agent used to process the silver halide light-sensitive photographic material of the present invention, for example, dihydroxybenzene compounds such as hydroquinone; 3-pyrazolidone compounds such as 1-phenyl-3-pyrazolidone and aminophenol compounds such as N-methylaminophenol can be used either singly or two or more kinds in combination. In the developing solution, if necessary, other known photographic additives for example, a preservative, an alkali agent, a pH buffer, an anti-foggant, a hardener, a development accelerator, an surface active agent, an anti-foaming agent, a color toning agent, a hardening agent, solubilization assisting agent and viscosity-conferring agent may also be used.

In the fixing solution, a fixing agent such as a thiosulfate or a thiocyanate is usually used. In addition, as a hardening agent a water soluble aluminium salt such as aluminium sulfate or potassium alum may be incorporated in the fixing solution. Further, other additives such as a preservative, a pH buffer and a water-softening agent may also be incorporated.

In the present invention, the silver halide light-sensitive photographic material is applicable to rapid processing with the processing time shorter than 40 seconds or less. In the present invention the term "time for the developing step" or "developing time" denotes the time between when the front end of the light-sensitive material starts being dipped in the developing solution and when it starts being dipped in the fixing solution. Similarly, the term "fixing time denotes the period between when the front end of the light-sensitive material starts being dipped in the fixing solution and when it starts being dipped in the washing tank solution or stabilizing solution and the term "rinsing time" denotes the period while the light-sensitive material is dipped in the washing tank solution. Moreover, the term "drying time" denotes the period while the light-sensitive material stays in the drying zone, which is usually arranged in an automatic processing machine, which is hereafter referred to simply as "processor'. In the developing process according to the present invention, times and temperatures under which the light-sensitive material is developed, is usually ten seconds or less and, more preferably, three to ten seconds at 25° to 50° C. and, more preferably, at 30° to 40° C.

As regards the fixing step, it is usually carried out for two to 12 seconds at 20° to 50° C. and, more preferably, for two to ten seconds at 30° to 40° C. and as regards washing or stabilizing process, it is usually for two to 15 seconds at zero to 50° C. and, more preferably, for two to eight seconds at 15° to 40° C. According to the method of the present invention, the photographic material as to which development, fixing and washing or stabilizing processes are carried out is subject to drying after it is passed through squeezing rollers, at which remaining water is squeezing out. Drying process is usually carried out at 40° to 100° C. and the time for the drying process may be varied depending on the surrounding temperature, and it is usually for three to 12 seconds and, more preferably, for three to eight seconds at 40° to 80° C. Still more advantageously, it is preferable to use a far-infrared heater.

According to the present invention, the silver halide light-sensitive material can be processed with the developing time shorter than ten seconds and with a replenishing amount of the developing solution at 200 ml or less per square meter of the silver halide light-sensitive photographic material.

In the light-sensitive photographic material of the present invention, the photographic emulsion layers and other hydrophilic colloidal layers can be provided on a support or on the other layer using various kinds of coating methods, which include, for example, dip-coating process, a roller coating, a curtain coating, extrusion coating process and slide hopper coating process. More specifically, those methods disclosed in the Research Disclosure on pages 27 and 28, volume No.176, under the title of "Coating procedures" may be applied.

In addition to the above, upon practicing the present invention, various techniques which are employed in the field of photography can be applied.

EXAMPLES

Below, the present invention is further explained with reference to working examples, however, the scope of the present invention is not limited by these examples.

Example 1

Preparation of a Seed Emulsion EM-A containing monodisperse cubic-shaped grains

| | |
|---|---|
| Solution A | |
| Osein gelatin | 30 g |
| KBr | 1.25 g |
| Nitric acid (0.1N) | 150 ml |
| Add distilled water to make the total volume | 7700 ml |
| Solution B | |
| KBr | 6 g |
| KI | 0.16 g |
| Add distilled water to make the total volume | 740 ml |

-continued

| | |
|---|---|
| Solution C | |
| KBr | 680 g |
| KI | 20 g |
| Add distilled water to make the total volume | 2480 ml |

-continued

| | |
|---|---|
| Solution D | |
| Silver nitrate | 8.4 g |
| Nitric acid (0.1N) | 32 ml |
| Add distilled water to make the total volume | 740 ml |
| Solution E | |
| Silver nitrate | 991.6 g |
| Nitric acid (0.1N) | 80 ml |
| Add distilled water to make the total volume | 2480 ml |

To Solution A, which is under vigorous agitation, Solution B and Solution D were added by double-jet method spending 10 minutes. Then Solution C and Solution E were added by double-jet method, spending 140 minutes. Herein the initial adding rate was one eighth of that at the final and it was linearly increased with lapse of time. While adding these solutions, pH and pAg of the mixture were maintained at a pH of 2 and a pAg of 8, respectively. After completion of addition, pH of the mixture was raised up to 6.0 with sodium carbonate and, then after 150 g of KBr was added the mixture was subjected to desalinization and washing to obtain a seed emulsion EM-A containing silver iodobromide grains, having an average grain diameter and silver iodide content of 0.3 μm and 2%, respectively. According to observation with a electron microscope, a ratio of twin crystals was less than one percent by number.

Preparation of regular-shaped core/shell emulsion EM-1

With five kinds of solutions given below, a silver halide emulsion EM-1 containing regular-shaped silver halide grains containing 2.0 mol % AgI.

| | |
|---|---|
| Solution A | |
| Osein gelatin | 75.5 g |
| $HO—(CH_2CH_2O)n-[CH(CH_3)CH_2O]_{17}—(CH_2CH_2O)mH$ (10% methanol solution; n + m = 5.7) | 15 ml |
| Seed emulsion EM-A | 0.928 mol equivalent |
| Add distilled water to make the total volume | 4000 ml |
| Solution B | |
| Silver nitrate | 151.3 g |
| Add equivalent amount of ammoniacal solution and distilled water to make the total volume | 848 ml |
| Solution C | |
| Silver nitrate | 890.9 g |
| Add equivalent amount of ammoniacal solution and distilled water to make the total amount | 1497 ml |
| Solution D | |
| KBr | 74.1 g |
| KI | 44.2 g |
| Add distilled water to make the total volume | 848 ml |
| Solution E | |
| KBr | 623.6 g |
| Add distilled water to make the total volume | 1497 ml |

While maintaining the temperature of Solution A at 40° C., and the pH of the solution was adjusted at 9.5 with ammoniacal water and acetic acid.

After adjusting the pAg with an ammoniacal silver ion solution at 7.3. Solution B and Solution D were added by double-jet method to form a silver iodobromide layer containing 30 mol % of silver iodide.

After adjusting the pH and pAg at 9.0 and 9.0, respectively, Solution C and Solution E were added simultaneously to grow the grains until size thereof to be 90% of that of the final grain diameter. At this time, pH was gradually reduced from 9.0 to 8.20.

After adding a KBr solution and adjusting a pAg at 11, Solutions C and E were further added to grow the grains while gradually reducing pH up to 8, to obtain a silver iodobromide emulsion containing 2 mol % iodide.

After completion of the addition, the following sensitizing dyes (A) and (B) were added and, then, in order to remove soluble salts from the system, coagulation desalinization was carried out with Demol (produced by Kao Atlas Co. Ltd.) and magnesium sulfate, and re-dispersed in 2500 ml total volume of an aqueous gelatin solution, containing 92.2 g of gelatin, to obtain a silver halide emulsion EM-1.

Sensitizing dye(A): 5,5'-dichloro-9-ethyl-3,3'-di-(3-sulfopropyl)oxacarbocyanine anhydride Sensitizing dye (B): sodium 5,5'-(dibutoxycarbonyl)-1,1'-diethyl- 3,3'-di-(4-sulfobutyl)benzoimidazolocarbocyanine anhydride Electron-microscopic observation of approximately 3,000 grains on the size and shape revealed that EM-1 contained mono-disperse and sphere-shaped silver halide grains of which average drain diameter and the width of distribution a coefficient of variation of grain sizes were 0.59 μm and 12%, respectively.

Preparation of a silver halide emulsion EM-B containing hexagonal tabular-shaped seed grains A silver halide emulsion containing hexagonal tabular-shaped seed grains was prepared according to the following method.

| | |
|---|---|
| Solution A | |
| Osein gelatin | 60.2 g |
| Distilled water | 20.0 ml |
| $HO—(CH_2(CH_3)CH_2O)_{17}—(CH_2CH_2O)mH$ (10% mnethanol solution: n + m = 5.7 | 5.6 ml |
| KBr | 26.8 g |
| 10% $H_2SO_4$ | 144 ml |
| Solution B | |
| Silver nitrite | 1487.5 g |
| Add distilled water to make the totalvolume | 3500 ml |
| Solution C | |
| KBr | 1029 g |
| KI | 29.3 g |
| Add distilled water to make the total volume | 3500 ml |
| Solution D | |
| 1.75N aqueous solution containing KBr | amount necessary to control silver potential given below: |

Nucleation was performed by adding 64.1 ml each of Solutions B and C to Solution A by the simultaneous mixing process spending two minutes.

After addition of Solutions B and C were stopped, the temperature of Solution A was raised up to 60° C. spending 60 minutes and, then, addition of Solutions B and C by the simultaneous mixing process and at the adding rate of 68.5 ml/min. were further carried out for another 50 minutes. During the addition, silver potential, which was measured using a silver selective electrode, by making use of a saturated silver-silver chloride electrode as a reference electrode, was controlled to be at +6 mv with Solution D.

After completion of addition, the pH of the emulsion was adjusted at 6 with 3% aqueous solution of KBr and, immediately thereafter, desalination was carried out, to obtain a seed emulsion EM-B. It was found from electron microscopic observation that this EM-B was a silver halide emulsion containing silver halide grains, more than 90% of the total projection area of which consist of hexagonal and tabular-shaped silver halide grains having the maximum adjacent edge ratio of 1.0 to 2.0, and the average thickness, average diameter (converted into that of a circle with equivalent area), an average aspect ratio and coefficient of variation of grain size of are 0.07 μm, 0.5 μm 7.1 and 25%, respectively.

Preparation of a silver halide emulsion containing EM-2 containing twin crystals Using four kinds of solutions given below, a silver halide emulsion EM-2 containing mono-disperse twinned crystal silver iodobromide grains, of which AgI content is 1.53 mol %.

| | |
|---|---|
| Solution A | |
| Osein gelatin | 29.4 g |
| $HO—(CH_2(CH_3)CH_2O)_{17}—(CH_2CH_2O)mH$ (10% mnethanol solution: n + m = 5.7 | 2.5 ml |
| Seed emulsion EM-B | 0.588 mol equivalent |
| Add distilled water to make the total volume | 4800 ml |
| Solution B | |
| Silver nitrate | 1404.2 g |
| Add distilled water to make the total volume | 2360 ml |
| Solution C | |
| KBr | 968 g |
| KI | 20.6 g |
| Add distilled water to make the total volume | 2360 ml |
| Solution D | |
| 1.75N aqueous solution containing KBr | amount necessary to control silver potential given below: |

By the use of a mixing stirrer disclosed in Japanese Patent Publication Nos., 58-58288(1983) and 58-58289(1983), nucleation was performed by adding 21.26 ml/min. each of Solution B and Solution C to Solution A by the simultaneous mixing process spending 111 minutes. During the addition, silver potential of the mixture was adjusted at +25 mv with Solution D.

After completion of the addition, 300 mg of sensitizing dye (A) and 15 mg of sensitizing dye (B) per mol of silver halide were added in a manner similar to EM-1. and, thereafter, in order to remove soluble salts from the system, coagulation desalinization was carried out by adding Demol (produced by Kao Atlas Co. Ltd.) and magnesium sulfate and the emulsion was re-dispersed in 2500 ml total volume of an aqueous gelatin containing 92.2 g of osein gelatin solution to obtain a silver halide emulsion EM-2.

Microscopic observation and measurements of approximately 3,000 grains on the size and shape resulted that EM-2 contains mono-disperse and sphere-shaped silver halide grains of which average grain diameter and the width of distribution (a coefficient of variation of grain size) are 0.59 μm and 18%, respectively.

Preparation of EM-3, containing tabular-shaped silver chloride grain

| | |
|---|---|
| Solution A | |
| High methionine gelatin (containing 59.7 mM of methionine per g gelatin) | 90 g |
| $CaCl_2.2H_2O$ | 440 g |
| Add distilled water to make the total | 6000 ml |
| Solution B | |
| Silver nitrite | 1017 g |
| Add distilled water to make the total volume | 1800 ml |

At 40° C., the pH of Solution A put in the mixing stirrer disclosed in Japanese Patent Publication Nos., 58-58288(1983) and 58-58289(1983) was adjusted at 5.1 and 29 ml of Solution B was added spending four minutes. Then, the rate of addition of the solution was linearly increased spending another 55 minutes (the additioning rate at the time of completion was 9.32 times as much as that at the time of the start), during which the total amount of Solution B was added. At 4, 16 and 36 minutes after initiation of addition of Solution B, 30 ml of 37 mM adenine solution was each added. Ten minutes thereafter, 3.78 g of 3M calcium chloride solution was added. While adenine and calcium chloride solution were added, an introduction of a silver nitrate solution was temporary stopped for a period of one minute and the additives were mixed uniformly, while pH of the solution was adjusted by adding NaOH or $HNO_3$ so as to be constant. Electron-microscopic observation of approximately 3,000 grains on the size and shape revealed that EM-3 contains mono-disperse and sphere-shaped silver halide grains of which average grain diameter thickness, sphere-converted diameter, aspect ratio and the width of distribution are 2.1 μm, 0.23 μm, 0.93 μm, 9.1 and 18%, respectively.

Preparation of EM-4 (containing tabular-shaped silver chlorobromide; $AgBr_{0.10}Cl_{0.90}$)

| | |
|---|---|
| Solution A | |
| High methionine gelatin (containing 59.7 mM of methionine per 1 g gelatin) | 30 g |
| 4,5,6-triaminopyridine | 100 g |
| NaCl | 246 g |
| NaBr | 14 g |
| Add distilled water to make the total | 6000 ml. |
| Solution B | |
| Silver nitrite | 1017 g |
| Add distilled water to make the total volume | 2000 ml. |

At 40° C., the pH of <Solution A> put in the mixing stirrer disclosed in Japanese Patent Publication Nos., 58-58288(1983) and 58-58289(1983) was adjusted at 5.6 and 6 ml of <Solution B> was added spending one minutes. Then, the rate of addition of the solution was linearly increased spending another 55minutes(the additioning rate at the time of completion was 9.8 times as much as that at the time of start), during which the total amount of Solution B was added. At 1, five and 18 minutes after the start of addition of Solution B, 120 ml of gelatin solution was each added. Five and 18 minutes thereafter, 400 g of 4M sodium chloride solution and 100 g of 20 mM- 4,5,6-triaminopyridine solution were added. While the above-mentioned solutions were added, introduction of silver nitrate solution was temporary stopped for the period of one minute and the additives were added, while the pH of the solution was adjusted by adding NaOH or $HNO_3$ so as to be constant. Electron-microscopic observation of approximately 3,000 grains revealed that EM-4 contains silver halide grains of which average grain diameter, thickness, sphere-equivalent diameter, aspect ratio and the width of distribution are 1.8 μm, 0.12 μm, 0.67 μm, 15.0 and 18%, respectively.

Preparation of EM-5 containing tabular-shaped silver chlorobromide ($AgBr_{0.50}Cl_{0.50}$)

This emulsion was prepared in the same manner as EM-4, except that in this emulsion 60 g of sodium bromide was added to the mixing vessel.

Electron-microscopic observation of approximately 3,000 grains revealed that EM-5 contains silver halide grains of which average grain diameter, thickness, sphere-equivalent diameter, aspect ratio and the width of distribution are 2.0 μm, 0.13 μm, 0.74 μm 15.3 and 18%, respectively.

Next, thus obtained emulsions were subjected to chemical and spectral sensitization according to the following manner.

After adjusting the temperature of the respective emulsions at 50° C. and 300 mg per mot of silver of sensitizing dye (A) was added, 7.0×10–4 mol per mol of silver of ammonium thiocyanate was added. Then, chemical sensitization was optimally carried out by adding auric chloride and sodium thiosulfate and, further, $10^{-3}$ mol/mol AgI, thereafter the emulsion was stabilized with $3\times10^{-2}$ mol of 4-hydroxy-6-methyl- 1,3,43a,7-tetrazaindene(TIA).

Preparation of samples

Coating solutions of the emulsions were prepared by adding various photographic additives to the respective emulsions. The coating solutions were each coated as a lower or upper layer as shown in Table 1. Amount of addition is shown in terms of that per a mol of silver halide.

| | |
|---|---|
| 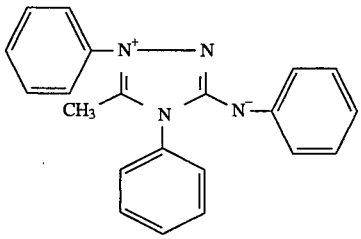 | 150 g |
| t-butyl-catecol | 400 mg |
| Polyvinylpyrrolidone | 1.0 g |
| Styrene-maleic acid anhydride copolymer | 2.5 g |
| Trimethylolpropane | 10 g |
| Diethyleneglycol | 5 g |
| Nitrophenyl-l-triphenyl-phosphonium chloride | 50 mg |
| Ammonium 1,3-dihydroxybenzene-4-sulfonate | 4 g |
| Sodium 2-mercaptobenzimidazole-5-sulfonate | 1.5 mg |
| 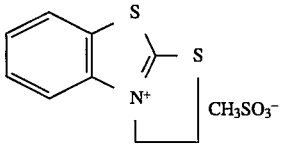 | 70 mg |

Additives used in the protective layer are as follows: The amount is given in terms of weight per gram of gelatin.

| | |
|---|---|
| Matting agent consisting of polymethylmethacrylate particles having area average particle diameter of 7 μm | 7 mg |

-continued

| | |
|---|---|
| Colloidal silica | 70 mg |
| 2,4-dichloro-6-hydroxyl,3,5-triazine sodium salt | 30 mg |
| Bis-vinylsulfonylmethyl ether amount to give the swelling percentage shown in Table 1 | |
| 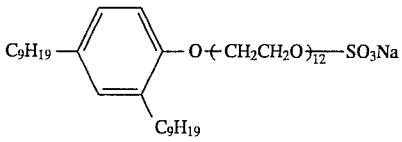 | 12 mg |
| 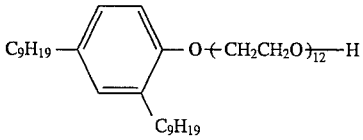 | 2 mg |
| $CH_2COO(CH_2)_9CH_3$ \| $CHCOO(CH_2)_2CH(CH_3)_2$ \| $SO_3Na$ | 7 mg |
| 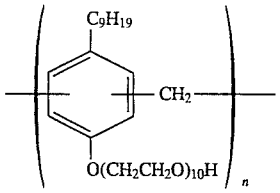 | 15 mg |
| $NaO_3S-CH(CH_2COOCH_2(C_2F_4)_3H)-COOCH_2(C_2F_4)_3H$ | 5 mg |
| $F_{19}C_9-O-(CH_2CH_2O)_{10}CH_2CH_2-OH$ | 3 mg |

With the use of the above-mentioned coating solutions, a lower layer, a upper layer and a protective layer were provided in this order from the support side on both surfaces of a 175-μm-thick polyethyleneterephthalate film substrate, which is subbed and colored in blue, and in the layer structure as shown in Table 1, to prepare Samples 1 through 22. Upon providing these layers, the amount of silver and gelatin were 1.6 g/m$^2$ and 1.4 g/m$^2$ with respect to the lower layer; 0.5 g/m$^2$ and 0.3 g/m$^2$ with respect to the upper layer and the amount of gelatin coated in the protective layer was 0.9 g/m$^2$.

<Sensitometric Evaluation>

Thus obtained samples were placed between a pair of fluorescent sensitizing sheet for x-ray exposure, XG-S, a product of Konica Corporation, and, after exposing to x-rays through a penetrometer Type-B (a product of Konica Medical Corporation) processed with a processing solution SR-DF in a processor SRX-503, both produced by Konica Corporation, for 45 seconds at 35° C.

Sensitivity of the samples were expressed in terms of relative values when reciprocal value of x-ray exposure to give the minimum density plus 0.1 on Sample No.1 is set as 100. Gamma(γ) is defined as tan θ, when inclination of a line, which passes through two points at which densities are 1.0 and 2.0. is denoted as θ. Thus it shows that the greater the value is, the higher is the gamma.

Further, the processor SRX-503 was modified so that the processing time is as given below, with respect to the samples which were exposed in the same manner, and replenishing of the processing solutions were made in amounts of 210 ml/m$^2$ and 170 ml/m$^2$ with respect to both developing and fixing solutions. And the same evaluations are carried out.

Developing time: 8 seconds

Fixing time: 6.3 seconds

Rinsing time: 3.4 seconds

Cross-over time between Rinsing and drying (squeezing): 2 seconds

Drying time: 5.3 seconds

Total processing time: 25 seconds

The following evaluation was made.

(Evaluation of roller-marks)

Using the processor SRX-501, in which a transporting roller was replaced with one having strong surface roughness, unexposed samples were processes for 45 seconds at 35° C. with the above-mentioned XD-SR processing solution, and, then, pressure marks in the samples caused due to pressure of the roller were evaluated according to the following five grades.

5: excellent; no roller-marks is observed

4: good; slightly observed

3: fair; a slight roller-marks observed

2: poor; many roller-marks observed

1: very poor; great many roller-marks observed (Evaluation of pressure resistance)

Respective unexposed samples with 13 mm×35 mm size were placed under the envionmental condition of 23° C., 42% R.H. approximately for one hour, and, then, they were folded with a radius curvature of 4 mm. Then they were processed without being subjected to exposure. Density difference between a density of the portion where additional density was caused by folding and fog density (ΔD)was measured. Thus the smaller the ΔD is, the better is the pressure resistance.

Results are shown in Table 1.

TABLE 1

| Sample No. | Emulsion No Lower Layer | Emulsion No Upper Layer | Swelling Ratio (%) | Total Processing Time: 45 seconds Replenishing Amount: 210 ml Sensitivity | Gamma | Total Processing Time: 25 seconds Replenishing Amount: 170 ml Sensitivity | Gamma | Total Processing Time: 45 seconds Replenishing Amount: 170 ml Sensitivity | Gamma | Roller-marks | Pressure Fog (ΔD) | Remarks |
|---|---|---|---|---|---|---|---|---|---|---|---|---|
| 1 | EM-1 | — | 220 | 100 | 1.9 | 98 | 1.8 | 95 | 1.6 | 1 | 0.20 | Comparison |
| 2 | EM-1 | — | 150 | 65 | 1.4 | 52 | 1.2 | 40 | 1.1 | 3 | 0.10 | Comparison |
| 3 | EM-2 | — | 220 | 110 | 2.0 | 108 | 1.9 | 105 | 1.8 | 1 | 0.35 | Comparison |
| 4 | EM-2 | — | 150 | 100 | 1.8 | 80 | 1.6 | 55 | 1.4 | 3 | 0.30 | Comparison |
| 5 | EM-2 | — | 100 | 70 | 1.4 | 48 | 1.2 | 35 | 1.0 | 4 | 0.15 | Comparison |
| 6 | EM-5 | — | 150 | 50 | 1.4 | 48 | 1.4 | 45 | 1.3 | 3 | 0.10 | Comparison |

TABLE 1-continued

| Sample No. | Emulsion No Lower Layer | Emulsion No Upper Layer | Swelling Ratio (%) | Total Processing Time: 45 seconds Replenishing Amount: 210 ml Sensitivity | Gamma | Total Processing Time: 25 seconds Replenishing Amount: 170 ml Sensitivity | Gamma | Total Processing Time: 45 seconds Replenishing Amount: 170 ml Sensitivity | Gamma | Roller-marks | Pressure Fog (ΔD) | Remarks |
|---|---|---|---|---|---|---|---|---|---|---|---|---|
| 7 | EM-1 | EM-3 | 220 | 120 | 2.1 | 119 | 2.0 | 117 | 1.8 | 1 | 0.30 | Comparison |
| 8 | EM-1 | EM-3 | 150 | 120 | 2.1 | 120 | 2.0 | 118 | 1.9 | 5 | 0.05 | Invention |
| 9 | EM-1 | EM-3 | 100 | 119 | 2.1 | 119 | 2.0 | 119 | 2.0 | 5 | 0.03 | Invention |
| 10 | EM-1 | EM-4 | 150 | 120 | 2.1 | 120 | 2.1 | 119 | 2.0 | 5 | 0.04 | Invention |
| 11 | EM-1 | EM-5 | 220 | 123 | 2.2 | 121 | 2.1 | 118 | 1.9 | 3 | 0.30 | Comparison |
| 12 | EM-1 | EM-5 | 150 | 122 | 2.2 | 121 | 2.1 | 121 | 2.0 | 5 | 0.03 | Invention |
| 13 | EM-2 | EM-3 | 220 | 122 | 2.2 | 120 | 2.0 | 118 | 1.8 | 1 | 0.35 | Comparison |
| 14 | EM-2 | EM-3 | 150 | 121 | 2.1 | 120 | 2.1 | 120 | 2.0 | 5 | 0.04 | Invention |
| 15 | EM-2 | EM-3 | 100 | 121 | 2.1 | 120 | 2.1 | 120 | 2.0 | 5 | 0.02 | Invention |
| 16 | EM-2 | EM-4 | 150 | 122 | 2.2 | 121 | 2.1 | 120 | 2.1 | 5 | 0.03 | Invention |
| 17 | EM-2 | EM-5 | 150 | 120 | 2.1 | 119 | 2.0 | 119 | 2.0 | 5 | 0.04 | Invention |
| 18 | EM-5 | EM-3 | 220 | 50 | 1.4 | 48 | 1.2 | 45 | 1.1 | 3 | 0.10 | Comparison |
| 19 | EM-5 | EM-3 | 150 | 45 | 1.3 | 43 | 1.1 | 42 | 1.0 | 4 | 0.08 | Comparison |
| 20 | EM-5 | EM-5 | 150 | 45 | 1.3 | 42 | 1.1 | 40 | 1.0 | 4 | 0.07 | Comparison |
| 21 | EM-1 | EM-2 | 220 | 110 | 2.0 | 108 | 1.8 | 105 | 1.6 | 1 | 0.30 | Comparison |
| 22 | EM-1 | EM-2 | 150 | 70 | 1.5 | 60 | 1.2 | 55 | 1.0 | 2 | 0.25 | Comparison |

From the results shown in Table 1, it is clearly understood that the samples according to the present invention have enhanced sensitivity and image quality, improved anti-roller mark and pressure resistance and, moreover, less fluctuation, even when processed rapidly and at a low replenishment. Similar results were obtained in the case of a silver chloride emulsion which was not subjected to chemical ripening.

According to the present invention, it is possible to provide a silver halide light-sensitive photographic material having enhanced sensitivity and image quality with less dependence on processing.

What is claimed is:

1. A silver halide black and white photographic light sensitive material comprising a support having on at least one side of the support hydrophilic colloidal layers including first and second silver halide emulsion layers, the first silver halide emulsion layer being provided on the second silver halide emulsion layer and the second silver halide emulsion layer being nearer to the support than the first silver halide emulsion layer, wherein said first silver halide emulsion layer comprises silver halide emulsion tabular grains containing 50 mol % or more chloride and having an average aspect ratio of 3 or more, said second silver halide emulsion layer comprising silver bromide grains or silver iodobromide grains containing 2 mol % or less iodide, and a swelling ratio of the total hydrophilic colloidal layers being 200% or less.

2. The silver halide photographic material of claim 1, wherein said tabular grains have an average thickness of less than 0.3 μm.

3. The silver halide photographic material of claim 1, wherein said tabular grains account for 50% or more of the projected area of total grains contained in said first silver halide emulsion layer.

4. The silver halide photographic material of claim 1, wherein said second layer comprises silver iodobromide grains containing 2 mol % or less iodide.

* * * * *